US006764715B2

(12) United States Patent
Janssen

(10) Patent No.: US 6,764,715 B2
(45) Date of Patent: Jul. 20, 2004

(54) SPATTER PAINTING

(76) Inventor: Robert Ives Janssen, 1160 Sibley Memorial Hwy., Mendota Heights, MN (US) 55118

( * ) Notice: Subject to any disclaimer, the term of this patent is extended or adjusted under 35 U.S.C. 154(b) by 0 days.

(21) Appl. No.: 10/207,663

(22) Filed: Jul. 29, 2002

(65) Prior Publication Data

US 2004/0018315 A1 Jan. 29, 2004

(51) Int. Cl.[7] ..... B05D 1/28
(52) U.S. Cl. ..... 427/256; 427/280; 427/428
(58) Field of Search ..... 427/256–288, 427/428; 15/230, 230.12

(56) References Cited

U.S. PATENT DOCUMENTS 2,865,325 A * 12/1958 Leston et al.
5,117,529 A * 6/1992 Ohta
5,713,095 A * 2/1998 Wakat

* cited by examiner

*Primary Examiner*—Fred J. Parker
(74) *Attorney, Agent, or Firm*—Jacobson & Johnson

(57) ABSTRACT

A method and apparatus for spatter painting wherein an open-loop paint applicator which can be a paint roller cover having a set of elongated interconnected members or fibers that are rolled in a shallow layer of paint, preferably a thixotropic paint, to randomly draw paint from the paint reservoirs onto peripheral portions of the open-loop members that extend into the paint reservoir to produce a partially loaded paint roller cover having randomly spaced globules and droplets of paint thereon. When the partially loaded paint roller cover is rolled over a surface the paint globules and droplets located in a random pattern on the paint roller cover are transferred to a surface to produce a "spatter effect" even though the paint roller cover normally produces a textured surface.

10 Claims, 3 Drawing Sheets

SPATTER PAINTING

FIELD OF THE INVENTION

This invention relates to decorative painting and, more specifically, to a system and method for spatter painting using either a paint roller or a paint pad.

CROSS REFERENCE TO RELATED APPLICATIONS

None

STATEMENT REGARDING FEDERALLY SPONSORED RESEARCH OR DEVELOPMENT

None

REFERENCE TO A MICROFICHE APPENDIX

None

BACKGROUND OF THE INVENTION

The concept of decorative painting using a paint roller cover is known in the art. In general a decorative pattern is formed directly in the paint roller cover. Using the paint roller cover with a decorative pattern one dips the paint roller cover in a paint tray and then rolls the paint roller cover over a surface to transfer the pattern on the paint roller cover to the surface. Typically, the paint roller cover pattern is obtained by forming a sculptured pattern directly in the nap of the paint roller cover or the paint roller cover can have an irregular surface formed by adhering different materials to the paint roller cover. In either case, a sculptured pattern is first formed in the paint roller cover. Once the sculptured pattern is formed in the paint roller cover the paint roller cover is loaded with paint by rolling the paint roller cover in a paint tray to distribute the paint over the raised portions of the paint roller cover and to also squeeze out excess paint from the paint roller cover. Once loaded with paint, the paint roller cover is rolled over a surface which transfers the pattern of the paint roller cover to the surface. This type of decorative painting can be described as "pattern transfer" or "roller cover pattern transfer" using "patterned rollers" since the pattern formed in the paint roller cover is transferred by rolling the patterned paint roller cover with paint thereon over a surface to be painted.

An example of such type of "pattern transfer" using a sculptured patterned roller cover can be found in the Notle U.S. Pat. No. 5,000,671 who uses an embossed design roller that is rolled over dry wall compound or other materials to transfer the roller pattern to the wall.

U.S. Pat. No. 5,206,979 shows pattern transfer where a rag is twisted around a paint roller cover to produce a decorative roller cover pattern.

Another type of pattern transfer roller is shown in U.S. Pat. No. 5,401,231 that uses a set of flexible leather discs on the roller to impart a textured effect.

U.S. Pat. No. 5,471,703 discuss an apparatus for applying paint to wall that creates a pattern transfer roller cover by wrapping a rag around the roller.

U.S. Pat. No. 5,996,166 discloses a pattern transfer paint roller that is formed by flexible strips.

U.S. Pat. No. 5,711,047 discloses a pattern transfer paint roller cover that produces a rag rolling effect.

U.S. Pat. No. 5,806,130 discloses a paint roller cover pattern formed by placing rag material on the sleeve to produce a rag rolled effect.

U.S. Pat. No. 6,142,921 discloses a paint roller cover wherein a patterned roller cover is created by having the fibers partially agglomerated so that when the roller is rolled over a surface it provides a sponge like finish.

From the above patents it is apparent the art of decorative painting involves creating a sculptured pattern surface on a paint roller cover and then loading the paint roller cover with paint and transferring the sculptured pattern of the paint roller cover to a surface. Pattern transfer with a sculptured paint roller cover is a well known technique as evidence by the many different types of patterns formed in the paint roller covers.

Another type of decorative painting is spatter painting. Typically, spatter painting is also known in the art and as the name suggests is a method of decorative painting where paint is spattered on to a surface. The method of spatter painting is to load paint onto the bristles of a paint brush and then shake the brush near the surface to spatter paint onto a surface. While this produces a true "spatter effect", the difficulties with this technique is that it is difficult to coat a large surface so that the "spatter effect" appears visually consistent over the entire surface. As a result the "spatter effect" often becomes overwhelmed by a splotch effect. That is, the size and shape of the spatter painting in one area predominates over the size and shape of spatter painting in another area thereby preventing one from creating a painted surface with the desired cohesiveness.

The present invention includes the discovery that wall paint coatings of thixotropic consistency when applied with an applicator roller of "loopy" surface perform to pick up and transfer to a wall surface a pattern of coating material that closely resembles the pattern obtainable by spatter painting techniques.

While conventional paint are useable with the mete I have discovered that the combination of a specific applicator tool and paint coating of thixotropic consistently perform in a superior manner to pick up and carry to a wall surface significantly more of the coating than if the coating was of a non-thixotropic consistency and a liquid when at rest.

The invention includes the discovery the wall paints of thixotropic consistency when applied with the roller applicator of loopy constriction deposits "spatters" of larger wads that do not run or flow down a vertical wall surface, as would the case with non-thixotropic paints.

The invention includes the discovery that an applicator tool of "loopy" surface construction when loaded with a the thixotropic material using a painter pallet having a lay of thixotropic pain that is patterned by forming furrows of relative uniform height and spacing appropriate to the height of the loops allows a precise loading and assures a uniform pattern of "spatters" on a wall surface.

The invention includes the discovery that the "spatter effect" can be rolled onto the surface rather than thrown at the wall form an overloaded bristle type paintbrush.

The invention also includes the option of simultaneously spattering paints of two or more colors in a single application by splitting the paint pallet and the loopy applicator roller two or more paint compartments each containing a paint of a different color.

The present invention provides a solution to the difficulty in uniformly laying down a spatter pattern through the discovery that the partial loading paint onto an open loop paint applicator that contains a nap pattern that normally applies a texture surface can be used to produce a spatter effect. In the preferred method a partially loaded open loop roller cover, which is normally used to applies a texture surface, is rolled over a surface to transfer paint droplets and paint globules in a spatter pattern with the spatter pattern different from the nap pattern of the roller. As a result a spatter pattern can be rolled over an entire surface while maintaining a cohesiveness to the spatter pattern.

The present method differs from the prior art decorative painting with transfer rollers since there is no nap pattern on the open-loop paint roller that is directly transferred to the painted surface. That is, with the present system and method one can generate a "spatter effect" without having to actually spatter the paint on the surface. Because the paint can be rolled on the surface with an open loop paint roller cover one can paint an entire surface with a "spatter effect" without introducing a splotch effect.

SUMMARY OF THE INVENTION

A method and system for spatter painting with a paint pad applicator or paint roller. In the preferred embodiment an open loop paint roller cover made from material known as "Nomad" has a nap pattern with the nap pattern formed by a set of irregular protruding members or fibers having interstitial regions therebetween. In one method the paint roller nap is partially immersed by rolling in a shallow layer of paint, preferably a thixotropic paint. Rolling the open-loop paint roller in the shallow layer of paint selectively and randomly draws paint from the paint reservoir onto random-like peripheral portions of the open-loop members. The result is a paint roller cover wherein fibers in random regions have paint globules or droplets thereon with the paint globules or droplets thereon positioned in a random like pattern throughout the peripheral surface of the paint roller cover. When the paint roller cover is rolled over a surface the random like pattern of paint globules or droplets on the paint roller cover is transferred from the paint carrying fibers to the surface. It has been discovered that the transfer of the random like pattern of globules or droplets on the nap to the surface provide a "spatter paint effect."

DESCRIPTION OF THE PREFERRED EMBODIMENT

Figure 1:
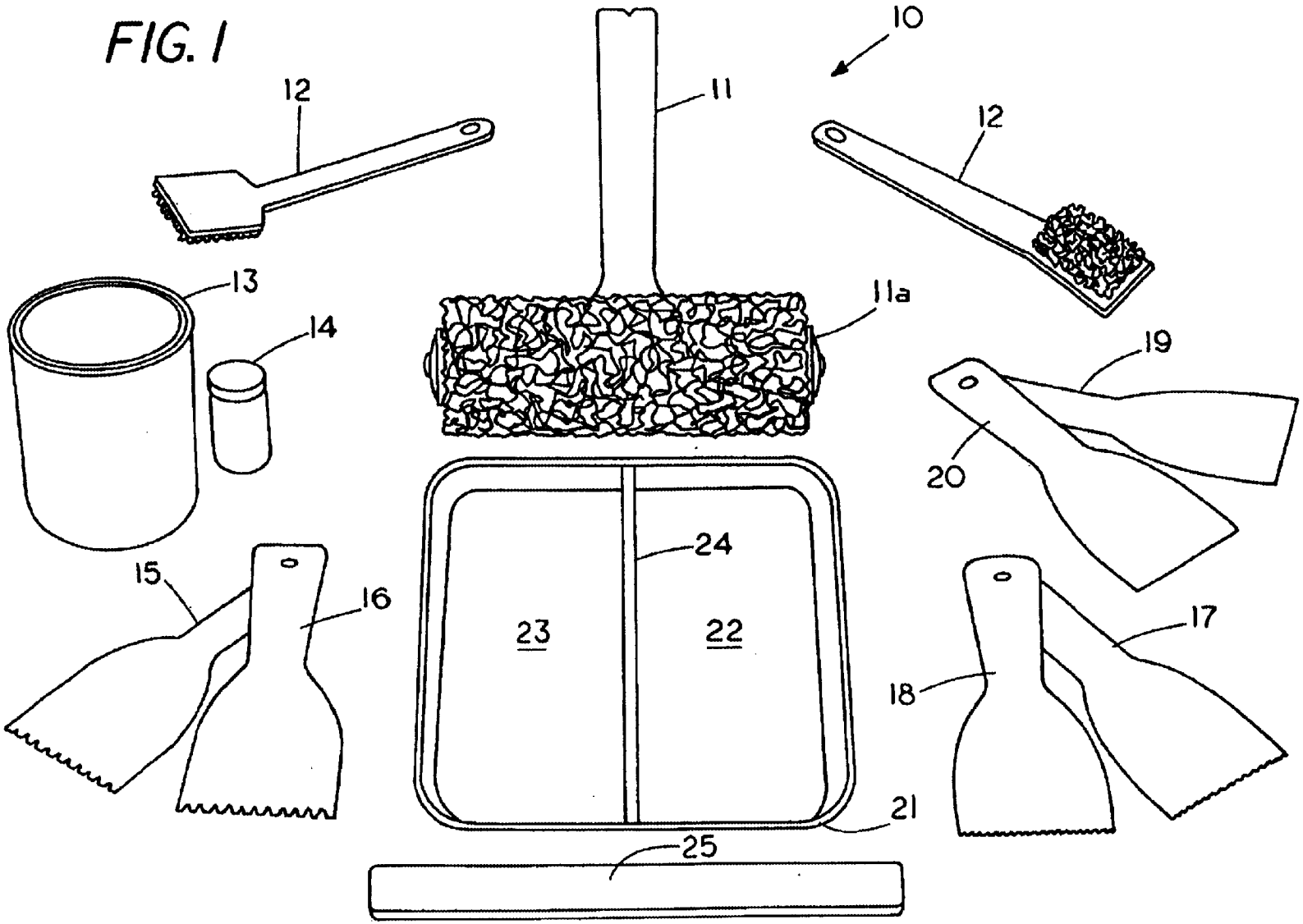
FIG. 1 is a view of the components of a kit for spatter painting.

FIG. 1 shows the contents of a system, which can be sold in kit form, for producing a "spatter paint effect" without actually spattering paint on the surface. The system includes a paint roller 11 having a set of spaced apart open-loop paint roller covers 11*a* thereon. Open-loop paint roller covers are known in the art as having "loopy" nap and are more fully described in my U.S. Pat. No. 4,191,792 tilted Paint Roller, which is hereby incorporated herein by reference. Generally, the open-loop paint roller covers are characterized by having a nap composed of elongated filaments which are bonded to each other at points where they touch to form open-loop elements having substantial interstitial open regions between the elements. This type of nap, which is commercially known as "Nomad" is conventionally used for producing textured painted surfaces by applying the paint to the paint roller and rolling the paint onto the surface. While conventionally used to apply textured surface I have discovered that the open-loop paint roller can be used to provide a "spatter effect".

The system includes a set of hand held paint applicators 12 each having a pad area with open-loop elements thereon for getting into corners and the like. These applicators are used to produce the "spatter effect" in corners and regions which are normally inaccessible to paint rollers.

The system includes a container of a white base paint 13 together with a colorant 14 to provide the user an opportunity to select the preferred color as well as a spatula 25 for mixing the base paint and the colorant. In the preferred embodiment, the container of paint contains a thixotropic paint. Thixotropic paints are known in the art in are sometimes in a fluid state and sometimes in a gel state. They general become fluid when stirred and return to a gel state when allowed to sit. An example, of a thixotropic paint is shown and described in Buter U.S. Pat. No. 4,311,622 which is hereby incorporated by reference. A feature of the thixotropic paint is that when in the gel state the paint has sufficient memory so that it can be extruded into a stable non-level condition.

System 10 includes a shallow paint tray 21 having a set of side-by-side shallow paint reservoirs 22 and 23 separated by a divider 24 to allow the spaced apart open-loop roller covers 11*a* to simultaneously load paint from each of the paint reservoirs. In the embodiments shown a dual roller and reservoir is shown; however, it should be appreciated that the present invention can produce a spatter effect with only a single roller and single reservoir or with three or more reservoirs and three or more rollers.

Included with system 10 are a set of six scraper blades 15, 16, 17, 18, 19 and 20. Blades 15 and 16 have identical edge relief patterns therein for extrudingly forming a layer of thixotropic paint in a paint tray into a set of non-level ridges and valleys. Similarly, blades 17 and 18 have identical edge relief patterns therein for extrudingly forming a thixotropic paint in a paint tray into a set of non-level ridges and valleys. Blades 17 and 18, which have different shape edge patterns from blades 15 and 16, give the user an option of extruding a different set of ridges and valleys. The blades 19 and 20 which are identical to each other contain a straight edge for removing paint from the paint tray when the task is finished.

Figure 2:
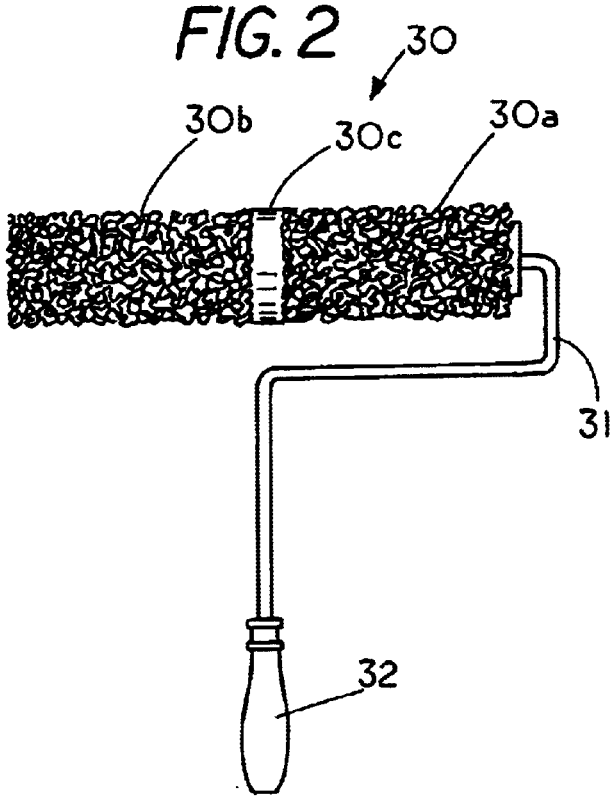
FIG. 2 is a front view of an open-loop paint roller.

To understand how the components shown in FIG. 1 can be used to produce a "spatter paint effect" reference should be made to FIG. 2 which shows a paint applicator comprising an open-loop paint roller 30 having an open-loop paint roller cover 30*a* and 30*b* thereon separated by a relief 30*c*. A frame 31 has a first end that rotatingly supports paint roller covers 30*a* and 30*b* and a second end having a hand grip 32. This type of open-loop paint roller is more fully described in my U.S. Pat. No. 4,191,792 and is hereby incorporated by reference.

Figure 3:
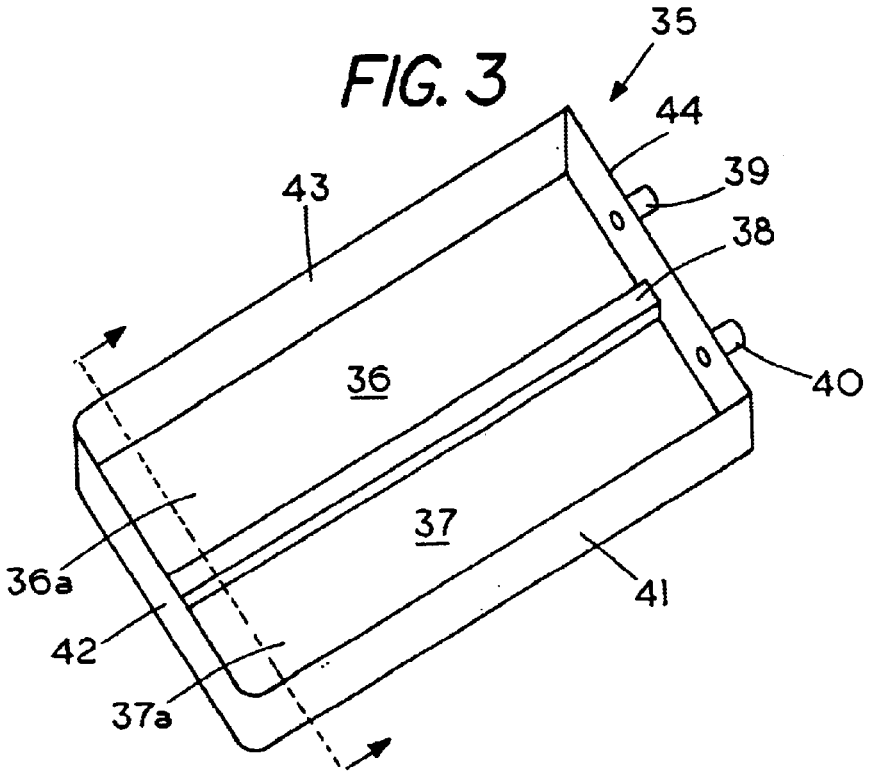
FIG. 3 is a perspective view of a paint tray for holding a thin layer of paint.

FIG. 3 shows a perspective view of the shallow paint tray 35 of the present invention. Paint tray 35 comprises a set of sidewalls 41, 42, 43, and 44 that extend around the periphery of the paint tray. A divider 38 extends from end to end of tray 35 to form a first compartment 36 having a flat bottom 36*a* and a second compartment 37, which is located in a side by side position to the compartment 36, with compartment 36 also having a flat bottom 37*a*.

In the embodiment shown side wall 44 includes a first spill over spout 39 and a second spill over spout 40 to limit the amount of paint that is introduced into the paint reservoirs. If the paint is thixotropic spill-over spouts are not needed; however, if a liquid such as a less viscous paint is used a user may want some way to limit the thickness of the layer of paint in the paint reservoirs 36 or 37.

Figure 4:
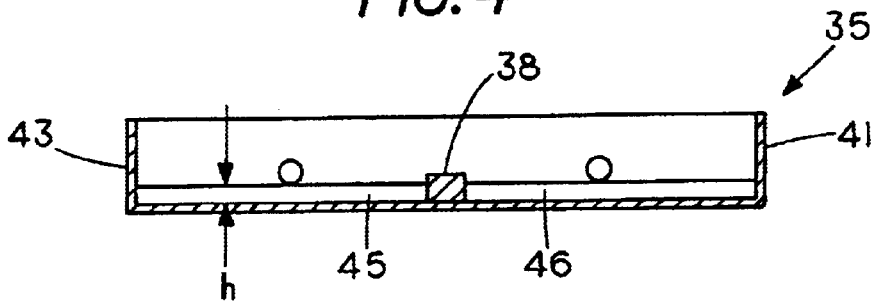
FIG. 4 is a cross sectional view taken along lines 4—4 of FIG. 3.

In order to appreciate the level of paint in the shallow reservoir reference should be made to FIG. 4 which shows the shallow paint tray 35 in cross section having a first layer of paint 45 having a depth "h" and a second layer of paint 46 also having a depth h. The paint in the reservoirs is separated by divider 38. The purpose of having two reservoirs is to provide the user the option of applying two different color paints at the same time. That is, each reservoir can contain a different color paint so that when applied by a roller two different color spatter patterns appear.

A feature of the elongated paint reservoirs is the flat bottom so that when placed on a level surface the depth of the paint in the paint reservoir, which is accessible to the paint applicator, remains constant throughout the paint reservoir thus preventing overloading of paint onto the paint roller.

Figure 5:
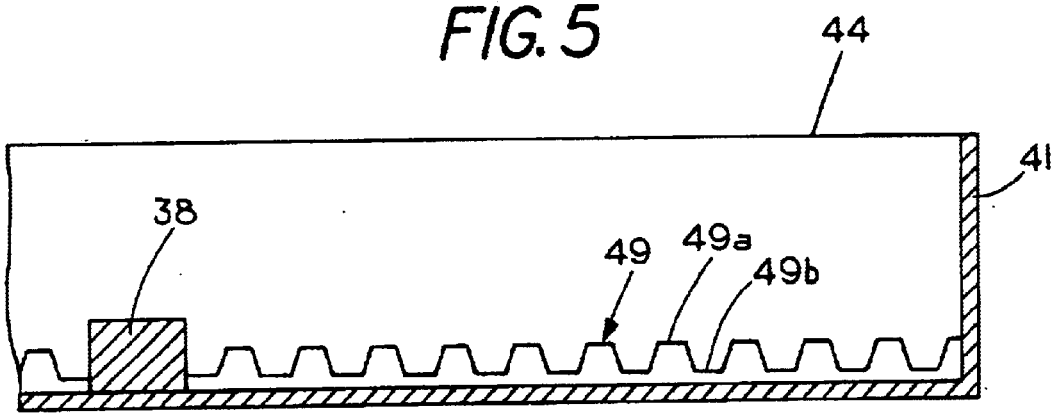
FIG. 5 is an enlarged cross sectional view of paint tray of FIG. 2.

FIG. 5 shows an enlarged view of a portion of the paint tray 35 with a layer of thixotropic paint 49 located therein. As pointed out, the thixotropic paint reverts to a gel state when allowed to set. When the paint is in the gel state one can take one of the blades such as blade 15 and form a set of elongated ridges 49*a* separated by valleys 49*b*. The result is that one creates an unequal loading area for the paint roller cover. When the unequal loading area is coupled with the open-loop paint roller cover the coacting of the unequal source and the unequal take up of the rollers enhances random securement of paint droplets and globules to the open-loop roller cover receiving the paint. When the paint on the roller is applied it appears as "spatter painting". A further benefit of the thixotropic paint is that when applied to the surface it does not run but adheres as applied, thereby enhancing the "spatter paint effect". Since the paint applicator is only partially loaded the "texturing pattern" of the paint applicator is avoided.

The preferred mode of the invention is with the thixotropic paints since the thixotropic paints do not run like liquid paints. In addition, the thixotropic paints allow one to introduce further irregularity into the finished surface since the gel like aspect of the thixotropic allows one to present different shaped loading surfaces to the applicator. Although the preferred mode is with thixotropic paints conventional viscous liquid paints can also be applied in the aforedescribed manner to create a "spatter effect" which some people may prefer. In any event the user has the option of obtaining the type of "spatter effect" by being able to use either a liquid viscous paint or the thixotropic paint with the "spatter effect" generally being enhanced by the use of thixotropic paint.

Figure 6:
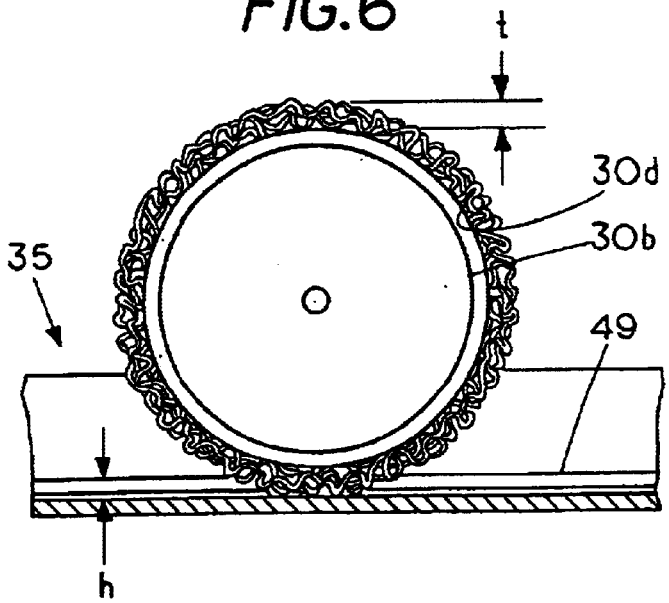
FIG. 6 shows a cross sectional view of a paint roller in a paint tray.

FIG. 6 shows a partial end view of a paint roller cover 30*b* rolling through a layer of paint 49 in the paint tray 35. Paint roller cover 30*b* is characterized by having open-loop elements 30*d* that extend a radial distance "t". The paint reservoir contains paint which extends to a depth "h" where the depth "h" is less than the thickness "t". While the thickness "h" will depend on the radial distance "t" a shallow layer of paint on the order of ⅛ of an inch or less is usually sufficiently to partially load the peripheral region of the paint roller cover.

In normal operation of the paint roller cover the paint roller cover is uniformly loaded with paint by rolling the paint roller cover in a paint tray. Rolling the paint roller cover onto a surface produces a textured painted surface. In one method of the present invention the fibers, which have a non regular pattern thereon, are allowed to extend only partially into the paint reservoirs not all of the paint roller fibers can pick up paint from the paint reservoirs. As a consequence of having fibers that do not extend completely into the paint one finds paint droplets and globules are randomly picked up by an individual fiber or groups of multiple fibers. By varying the amount of loading of the paint roller by controlling the depth of the roller allows one to control the amount of paint that is picked up by the open loop applicator.

If the entire roller nap of open-loop members are allowed to extend uniformly into the paint reservoirs one obtains a paint roller cover with uniformly spaced regions of paint that correspond directly to the nap pattern on the paint roller cover. When such a fully loaded paint roller cover is rolled onto a surface it produces the aforementioned textured surface.

However, in the present invention it has been discovered that using a paint roller cover that contain a fibrous or irregular nap surface where only a portion of the peripheral fibers or elements have been extended into the paint reservoirs does not reproduce the roller pattern nor does it produce a textured surface. In the present invention instead of having a paint roller cover with paint uniformly held in spaced apart regions the paint roller cover includes fibers or elements wherein only some regions contain droplets or globules of paint thereon.

As a result, a paint applicator or paint roller wherein an open-loop paint roller cover having a nap pattern where the nap pattern is formed by a set of irregular protruding members or fibers having interstitial regions therebetween can be used to form a "spatter effect". During the process the paint roller is partially immersed and rolled in a shallow layer of paint, preferably a thixotropic paint. Rolling the open-loop paint roller in the shallow layer of paint selectively and randomly draws paint from the paint reservoir onto random peripheral portions of the open-loop members that extend into the paint reservoir. The result is a paint roller cover wherein fibers in selective regions have paint globules or droplets thereon with the paint globules or droplets thereon spaced in a random like pattern on the peripheral region of the paint roller cover. When the paint roller cover is rolled over a surface the random pattern of paint globules or droplets on the paint roller cover is transferred from the paint carrying fibers to the surface. It is this random pattern of transferred globules or droplets on the nap that results in a rolled on "spatter effect". Thus limiting the loading of the open-loop paint roller cover prevents the paint roller cover from delivering a textured surface.

A feature of a paint roller cover 30*b* is that by shallow loading only some fibers or elements carry paint droplets and other fibers or elements carry no paint droplets. As a result the paint roller cover 30*b* and 30*a* contain randomly spaced regions where paint is located on those individual fibers or fibers which have come into contact with the paint in the paint reservoir.

Thus the method of spatter painting comprising the steps of: introducing a paint into a paint reservoir in a paint tray until a depth of the paint in the paint reservoir reaches a level h; placing an open-loop paint roller cover in the paint roller with the open-loop paint roller cover having a thickness "t" where the thickness "t" is greater than the level "h"; rolling an open-loop paint roller cover in the paint reservoir to selectively transfer a portion of the paint from the paint reservoirs to a portion of the paint roller cover; and rolling the paint roller cover over a surface to produce a spatter paint effect.

I claim:

1. A method of spatter painting with a texture applicator comprising the steps of:

introducing a viscous paint into a paint reservoir in a paint tray until a depth level of the paint in the paint reservoir reaches the depth level "h";

placing an open-loop paint roller cover having elements with substantial interstitial open space therebetween with the open-loop paint roller cover elements having a radial thickness "t" where the radial thickness "t" is greater than the depth level "h" so that only a peripheral portion of the elements are immersible in the paint in the paint reservoir;

rolling the open-loop paint roller cover in the paint reservoir to randomly transfer a portion of the paint from the paint reservoir to some of the elements in the peripheral portion of the paint roller cover in the form of randomly spaced droplets or globules to thereby form a partially loaded paint roller cover;

removing the partially loaded open-loop paint roller cover from the paint reservoir; and rolling the partially loaded paint roller cover over a surface to thereby produce a spatter paint effect by the transfer of the randomly spaced droplets or globules from the peripheral portion of the partially loaded paint roller cover to the surface.

2. The method of claim 1 including the step of introducing a viscous paint comprises introducing a thixotropic paint into the paint reservoir.

3. The method of claim 2 wherein the step of introducing the thixotropic paint into the reservoirs includes the step of stroking a blade over the paint to form an uneven top surface on the thixotropic paint in the reservoir.

4. A method of spatter painting comprising randomly loading an open-loop paint roller cover having a set of elongated fibers with interstitial openings therebetween by first rolling the paint roller cover over a layer of a viscous paint so that the viscous paint randomly adheres to only an outer peripheral portion of the elongated fibers; and then rolling the paint roller cover over a surface to transfer the paint randomly adhered to the outer peripheral portion of the elongated fibers onto the surface to provide a spatter effect without an actual paint spattering.

5. The method of claim 4 wherein the open-loop paint roller cover has at least two spaced apart regions of open-loop elements which are simultaneously rolled into separate paint reservoirs.

6. A method of spatter painting with a texture applicator comprising:

partially loading an open-loop paint texture applicator with a thixotropic paint to cause an exterior portion of the elongated members to retain the thixotropic paint at random locations on the applicator while preventing a further interior portion of the elongated members from contacting the thixotropic paint source by placing the applicator on a furrowed surface of the thixotropic paint; and applying the thixotropic paint on the elongated members onto a surface to transfer the thixotropic paint at random locations on to the surface to thereby produce a spatter paint effect without an actual paint spattering.

7. The method of claim 6 including the step wherein the thixotropic paint comprises a layer of paint less than ⅛ of an inch.

8. The method of claim 6 including the step of rolling the thixotropic paint onto the surface.

9. A method of spatter painting with a texture applicator comprising the steps of:

introducing a viscous paint comprising a thixotropic paint into a paint reservoir in a paint tray until a depth level of the paint in the paint reservoir reaches the depth level "h";

stroking a blade over the paint to form an uneven top surface on the thixotropic paint in the reservoir;

placing an open-loop paint roller cover having elements with substantial interstitial open space therebetween with the open-loop paint roller cover elements having a radial thickness "t" where the radial thickness "t" is greater than the depth level "h" so that only a peripheral portion of the elements are immersible in the paint in the paint reservoir;

rolling the open-loop paint roller cover in the paint reservoir to randomly transfer a portion of the paint from the paint reservoir to some of the elements in the peripheral portion of the paint roller cover in the form of randomly spaced droplets or globules to thereby form a partially loaded paint roller cover;

removing the partially loaded open-loop paint roller cover from the paint reservoir; and rolling the partially loaded paint roller cover over a surface to thereby produce a spatter paint effect by the transfer of the randomly spaced droplets or globules from the peripheral portion of the partially loaded paint roller cover to the surface.

10. The method of claim 9 wherein at least two different thixotropic paints are introduced into two side by side paint reservoirs in the paint tray.

* * * * *